US009966016B2

(12) United States Patent
Hsieh et al.

(10) Patent No.: US 9,966,016 B2
(45) Date of Patent: May 8, 2018

(54) DISPLAY METHOD AND DISPLAY

(71) Applicant: AU OPTRONICS CORPORATION, Hsin-chu (TW)

(72) Inventors: Hsiang-Yuan Hsieh, Hsin-chu (TW); Min-Yao Lu, Hsin-chu (TW); Chin-Tang Chuang, Hsin-chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 178 days.

(21) Appl. No.: 15/205,639

(22) Filed: Jul. 8, 2016

(65) Prior Publication Data

US 2017/0243549 A1 Aug. 24, 2017

(30) Foreign Application Priority Data

Feb. 19, 2016 (TW) ..... 105104980 A

(51) Int. Cl.
*G09G 3/34* (2006.01)

(52) U.S. Cl.
CPC ..... *G09G 3/3413* (2013.01); *G09G 3/3426* (2013.01); *G09G 2310/0235* (2013.01); *G09G 2320/0242* (2013.01); *G09G 2320/0666* (2013.01)

(58) Field of Classification Search
CPC ... G09G 2310/0235; G09G 2320/0242; G09G 2320/0666; G09G 3/3413; G09G 3/3426
See application file for complete search history.

(56) References Cited

U.S. PATENT DOCUMENTS

| | | | |
|---|---|---|---|
| 6,831,948 | B1 | 12/2004 | Van Dijk et al. |
| 8,184,087 | B2 | 5/2012 | Lin et al. |
| 8,203,521 | B2 | 6/2012 | Lin et al. |
| 2007/0046914 | A1 | 3/2007 | Lee |
| 2012/0007900 | A1 | 1/2012 | Murai et al. |

FOREIGN PATENT DOCUMENTS

| | | |
|---|---|---|
| TW | I410938 B | 10/2013 |

*Primary Examiner* — Latanya Bibbins
(74) *Attorney, Agent, or Firm* — Tim Tingkang Xia, Esq.; Locke Lord LLP

(57) ABSTRACT

A display method adapted to a display device. The display method includes: displaying first, second and third color fields respectively in first, second and third time periods such that each pixel have a background color; determining, from the pixels, multiple color breakup pixels according to the second color field of each pixel, the first color field of a first peripheral pixel of each pixel, the third color field of a second peripheral pixel of each pixel, and the background color of each pixel; calculating a color breakup color of each color breakup pixel; calculating a compensation color of each color breakup pixel according to the background color and the color breakup color of the color breakup pixel; and displaying a fourth color field in a fourth time period. For each color breakup pixel, the compensation color is displayed in the fourth color field.

10 Claims, 9 Drawing Sheets

DISPLAY METHOD AND DISPLAY

CROSS-REFERENCE TO RELATED APPLICATIONS

This non-provisional application claims priority under 35 U.S.C. § 119(a) on Patent Application No. 105104980 filed in Taiwan, R.O.C. on Feb. 19, 2016, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

TECHNICAL FIELD

The present disclosure relates to a display method and a display device, and in particular, to a display method and a display device that reduces a color breakup phenomenon.

BACKGROUND

As electronic products become popular, a large quantity of liquid crystal displays are applied to 3C products such as televisions, mobile phones, notebook computers, and tablet computers. Generally, a conventional liquid crystal display needs to use color filters and a large quantity of transistors to display images having different colors. Therefore, to save space usage inside a display and a cost, at present a field sequential color (FSC) display is developed in the industry. In the FSC display, different light-emitting diodes can respectively emit red (R), green (G), and blue (B) light at a particular time, and the three major primary colors are mixed.

A switching speed of the FSC display exceeds a frequency (that is, 60 Hz) perceptible to human eyes, and therefore, human brains superimpose all pictures because of persistence of vision; therefore, a user perceives a full-color picture. In an ideal condition, pixels corresponding to light of three colors in the FSC display are projected onto a same position on a retina, and therefore color information of each pixel can be completely reproduced in vision.

However, if the pixels corresponding to light of three colors in the FSC display are projected onto different positions on the retina, the user observes an image in which color fields are separate and misaligned, which is a color breakup (CBU) phenomenon. A color breakup phenomenon is especially severe at an edge of an object in an image.

SUMMARY

An aspect of the present disclosure provides a display method adapted to a display device including a plurality of pixel. The display method includes: displaying a first color field, a second color field, and a third color field respectively in a first time period, a second time period, and a third time period such that each of the pixels is configured to display a background color, where for each of the pixels, a first peripheral pixel is determined to be at a distance from the pixel along a first direction on the display device, and a second peripheral pixel is determined to be at the distance from the pixel along a second direction opposite the first direction; determining, from the pixels, a plurality of color breakup pixels according to the second color field of each of the pixels, the first color field of the first peripheral pixel of each of the pixels, the third color field of the second peripheral pixel of each of the pixels, and the background color of each of the pixels; calculating, for each of the color breakup pixels, a color breakup color of the color breakup pixel according to the second color field of the color breakup pixel, the first color field of the first peripheral pixel of the color breakup pixel, and the third color field of the second peripheral pixel of the color breakup pixel; calculating a compensation color of each of the color breakup pixels according to the background color and the color breakup color of the color breakup pixel; and displaying, for each of the pixels, a fourth color field in a fourth time period, where each of the color breakup pixels is configured to display the compensation color in the fourth color field.

In certain embodiments, the calculating a compensation color of each of the color breakup pixels further includes: converting the background color and the color breakup color of each of the color breakup pixels to numerical values in a chromaticity coordinate by using a conversion matrix; computing a difference between the numerical values of the background color and the numerical values of the color breakup color of each of the color breakup pixels in the chromaticity coordinate; and converting the difference between the numerical values of the background color and the numerical values of the color breakup color of each of the color breakup pixels to the compensation color by using an inverse matrix of the conversion matrix, to obtain the compensation color of each of the color breakup pixels.

In certain embodiments, the first direction is a horizontal direction on the display device, and the distance is at least one pixel width.

In certain embodiments, at least one of the first color field, the second color field, and the third color field is a single color field.

In certain embodiments, the first color field is a red color field, the second color field is green color field, and the third color field is a blue color field.

In certain embodiments, at least one of the first color field, the second color field, and the third color field is a mixed color field, and the pixels in the mixed color field are configured to display light of at least two single colors.

In certain embodiments, the display method further includes: calculating the compensation color of each of the color breakup pixels according to the background colors of the pixels adjacent to the color breakup pixel and the color breakup color of the color breakup pixel.

In certain embodiments, the display method further includes: detecting an eyeball moving speed of an observer to generate speed information; and calculating, as the distance, a distance of translation of the first color field and the third color field according to the speed information.

Another aspect of the present disclosure provides a display device. The display device includes a display panel and a controller. The display panel includes a plurality of pixels. The display panel is configured to display a first color field, a second color field, and a third color field respectively in a first time period, a second time period, and a third time period such that each of the pixels is configured to display a background color, where a first peripheral pixel is determined to be at a distance from the pixel along a first direction on the display device, and a second peripheral pixel is determined to be at the distance from the pixel along a second direction opposite the first direction. The controller includes an image analysis unit and a computation unit. The image analysis unit is configured to determine, from the pixels, a plurality of color breakup pixels according to the second color field of each of the pixels, the first color field of the first peripheral pixel of each of the pixels, the third color field of the second peripheral pixel of each of the pixels, and the background color of each of the pixels. The computation unit is configured to calculate, for each of the color breakup pixels, a color breakup color of the color breakup pixel according to the second color field of the color breakup pixel, the first color field of the first peripheral pixel of the color breakup pixel, and the third color field of the second peripheral pixel of the color breakup pixel, and calculate a compensation color of each of the color breakup pixels according to the background color and the color breakup color of the color breakup pixel, where the display panel is further configured to display a fourth color field in a fourth time period, and each of the color breakup pixels is configured to display the compensation color in the fourth color field.

In conclusion, a color breakup phenomenon is effectively reduced by displaying a compensation color of each color breakup pixel. In addition, in some embodiments, spatial color mixing is further achieved by using a mixed color field. Alternatively, in some embodiments, when a color difference between a background color and a color breakup color is relatively large, a compensation color may be calculated by using a background color of an adjacent pixel. Further alternatively, in some embodiments, an eyeball moving speed of an observer may be further considered to determine a pixel in which a color breakup phenomenon may occur.

To make the foregoing features and advantages of the present invention more comprehensible, embodiments are particularly listed below with reference to the accompanying drawings, which are described in detail below.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment.

DETAILED DESCRIPTION OF THE DISCLOSURE

Figure 1:
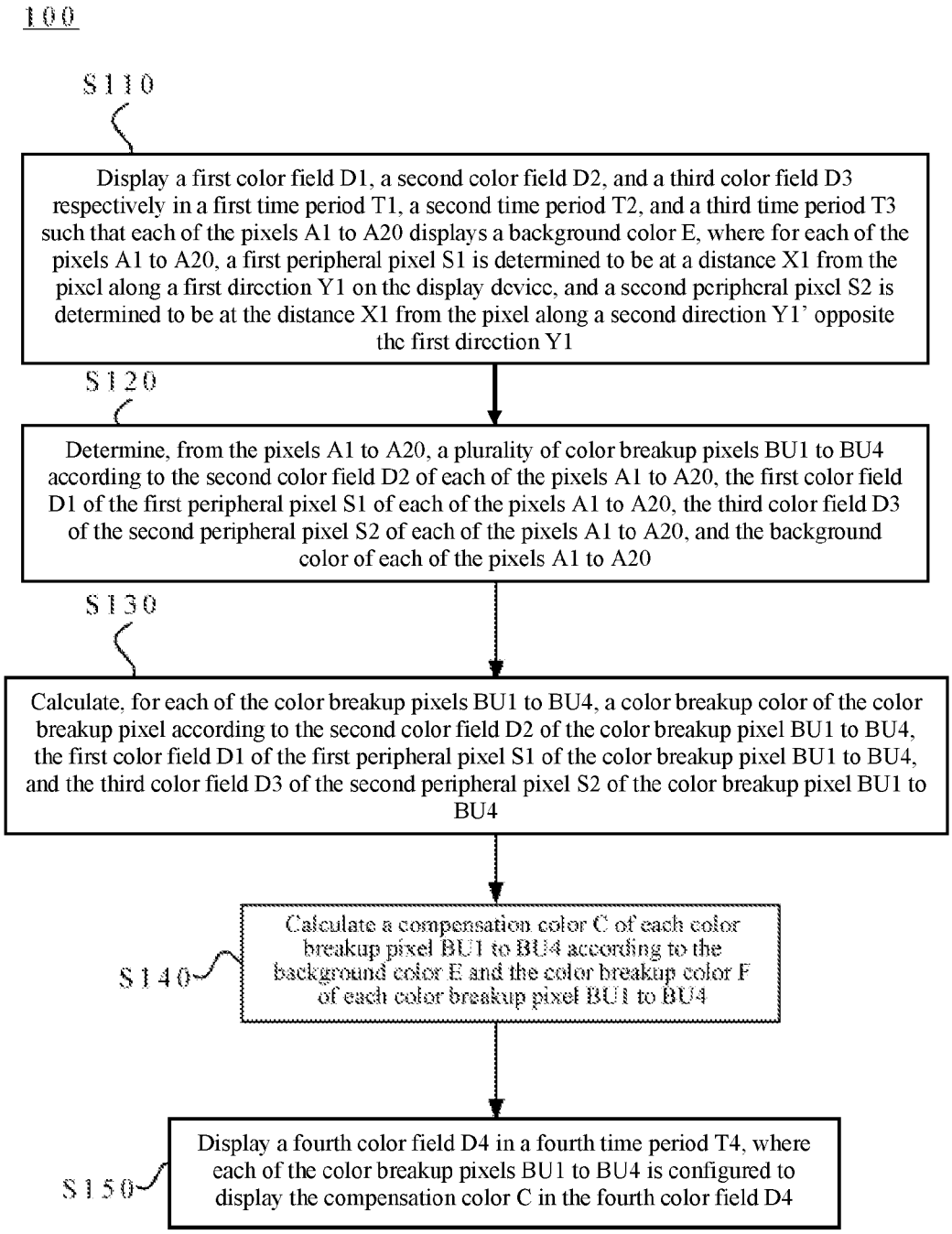
FIG. 1 is a schematic flowchart of a display method according to an embodiment of the present disclosure.

The following discloses and provides many different embodiments or examples used to implement different features of the present invention. Elements and configurations in special examples are used in the following discussion to simplify the present disclosure. Any discussed example is only used for illustrative purposes, and does not limit the scope and meaning of the present invention or examples of the present invention in any manner. In addition, numerical symbols and/or letters may be repeatedly used in different examples of the present disclosure, and all these repetitions are for simplification and description, and do not specify relationships between different embodiments and/or configurations in the following discussion.

The terms used in the entire specification and the claims, unless specifically indicated, usually have common meanings of the terms used in the art and in the disclosed content and special content. Some terms used to describe the present disclosure are discussed below or somewhere else in this specification, so as to provide additional guidance in the description of the present disclosure to a person skilled in the art. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top", and "left" and "right", may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper", depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the term "unit" may refer to, be part of, or include an Application Specific Integrated Circuit (ASIC); an electronic circuit; a combinational logic circuit; a field programmable gate array (FPGA); a processor (shared, dedicated, or group); a controller (shared, dedicated, or group) that executes computer executable code; other suitable hardware components that provide the described functionality; or a combination of some or all of the above, such as in a system-on-chip. The term "unit" may include memory (shared, dedicated, or group) that stores code executed by the processor.

"Coupling" or "connecting" used herein may both refer to that two or more elements are in direct physical or electrical contact, or are in indirect physical or electrical contact, while "coupling" or "connecting" may also refer to that two or more elements are interoperable or interacting. Herein, it may be understood that words such as first, second and third are used to describe various elements, components, areas, layers and/or blocks. However, these elements, components, areas, layers and/or blocks should not be limited by these terms. These words are only used for distinguishing between single elements, components, areas, layers and/or blocks. Therefore, a first element, component, area, layer and/or block hereinafter may also be referred to as a second element, component, area, layer and/or block without departing from the concept of the present invention. As used herein, the words "and/or" include one of the listed items or any combination of multiple of the listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Figure 2:
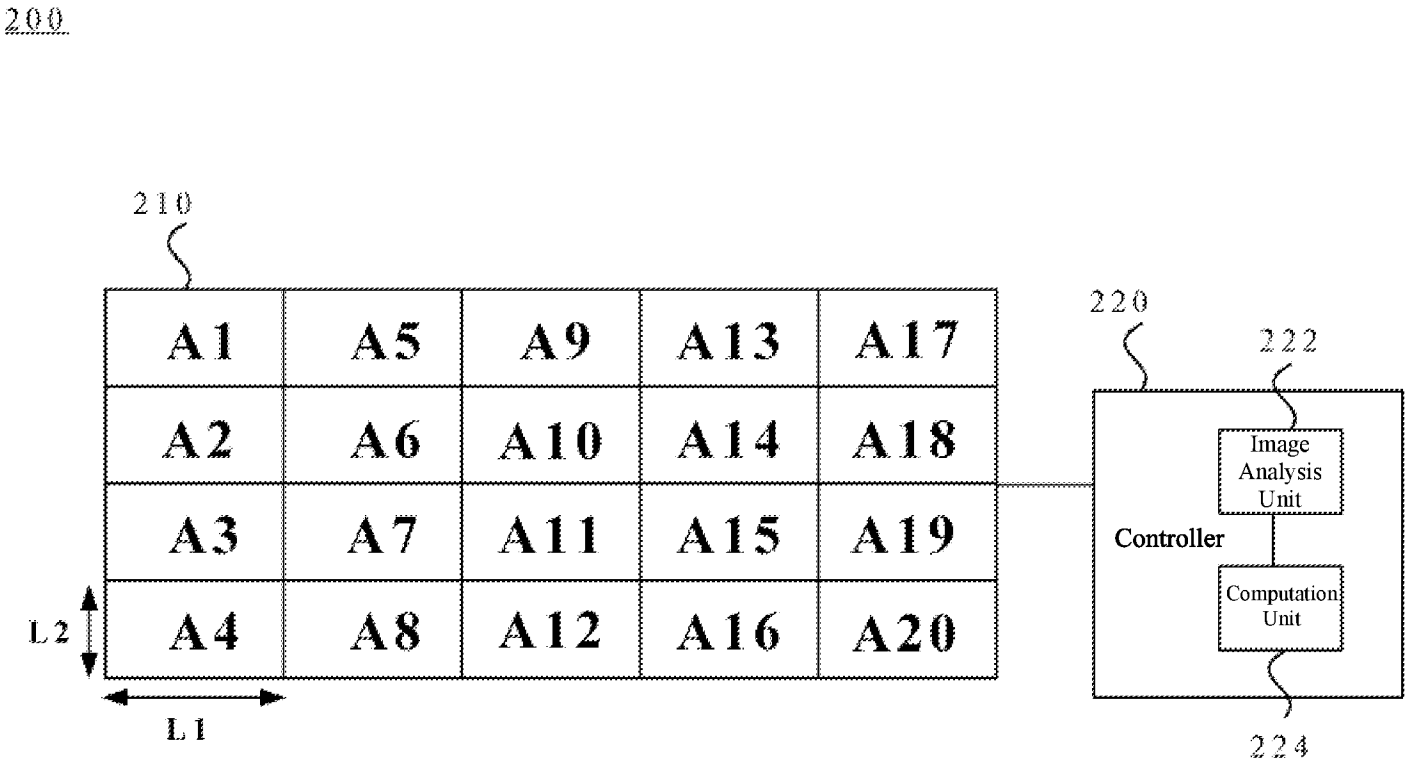
FIG. 2 is a schematic diagram of a display device according to an embodiment of the present disclosure.

FIG. 1 is a schematic flowchart of a display method 100 according to an embodiment of the present disclosure. FIG. 2 is a schematic diagram of a display device 200 according to an embodiment of the present disclosure. In some embodiments, the display device 200 may be, for example, an FSC display or any display having a display panel 210 and a controller 220, and the present disclosure is not limited thereto. The display method 100 as shown in FIG. 1 may be applied to the display device 200 as shown in FIG. 2. The display method 100 includes steps S110 to S150.

As shown in FIG. 2, the display 200 includes a display panel 210 and a controller 220. It should be noted that, in an actual application, the display 200 may include more components, for example, components such as a driver and a backlight module, and the schematic diagram as shown in FIG. 2 only illustrates some of the components for ease of description. The display panel 210 includes pixels A1 to A20 formed in a matrix, and similarly, an example of 20 pixels is shown herein for ease of description only. In an actual application, a quantity of pixels included in the display panel 210 may be any quantity, and is not limited thereto. As shown in FIG. 1, in Step S110, the display panel 210 is configured to display a first color field D1, a second color field D2, and a third color field D3 respectively in a first time period T1, a second time period T2, and a third time period T3 such that each pixel A1 to A20 displays a background color E. For each pixels A1 to A20, a first peripheral pixel S1 is determined to be at a distance X1 from each pixel A1 to A20 along a first direction Y1 on the display device, and a second peripheral pixel S2 is determined to be at the distance X1 from each pixel A1 to A20 along a second direction Y1' opposite the first direction Y1.

Figure 3A:
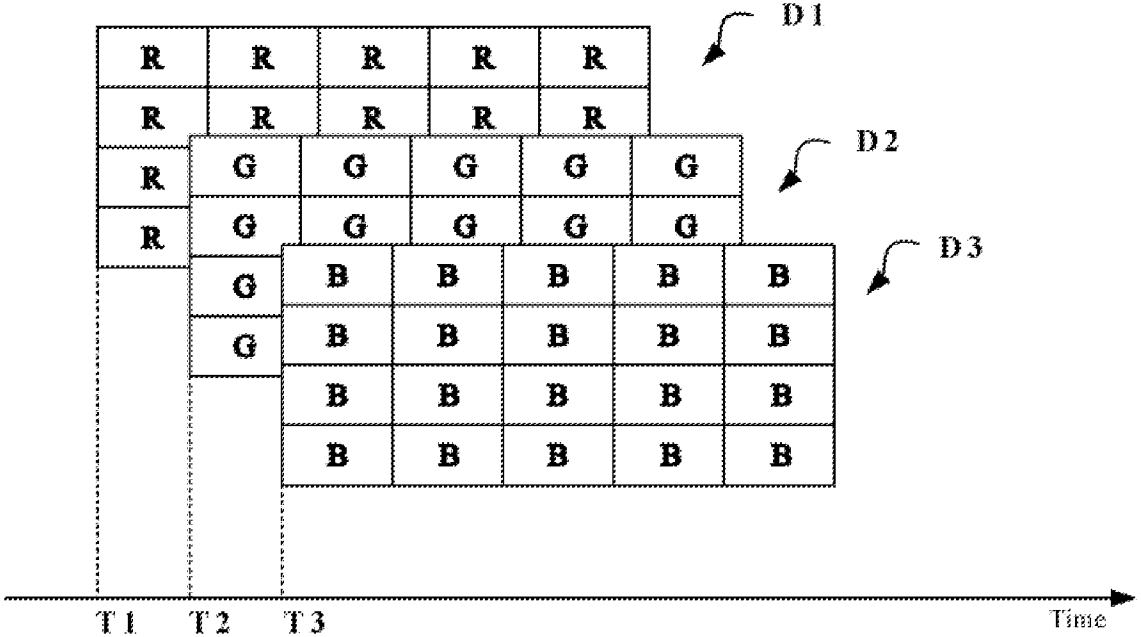
FIG. 3A is a schematic concept diagram according to steps in the display method as shown in FIG. 1.

Furthermore, FIG. 3A is a schematic concept diagram according to Step S110 in the display method 100 as shown in FIG. 1. Generally, in an image of a picture, proportions of weights of different colors are different. For example, during an RGB analysis using three primary colors of red (R), green (G), and blue (B), the red, green, and blue colors in the image may respectively account for a weight of a particular proportion. When the weight of the red color in the image is high, the image is excessively with red tone in the visual presentation. When the weight of the green color in the image is high, the image is excessively with green tone in the visual presentation. When the weight of the blue color in the image is high, the image is excessively with blue tone in the visual presentation. Therefore, the display panel 210 in the display device 200 may display, at a different time (the first time period T1, the second time period T2, and the third time period T3), a color field (the first color field D1, the second color field D2, and the third color field D3) of a different color in the image, such that each pixel A1 to A20 respectively displays the background color E that the image should have. As shown in FIG. 3A, in this embodiment, the first color field D1, the second color field D2, and the third color field D3 are respectively a red color field, a green color field, and a blue color field. That is, each color field is a single color field, in which all pixels A1 to A20 display the same single color. However, in another embodiment, the first color field D1, the second color field D2, and the third color field D3 may respectively be single color fields of other colors. Alternatively, in certain embodiments, at least one of the first color field D1, the second color field D2, and the third color field D3 is a single color field, and the present disclosure is not limited to the foregoing example.

It should be noted that, the first time period T1, the second time period T2, and the third time period T3 are only different time periods and do not have a fixed time sequence or order. In other words, a time order in which the first color field D1, the second color field D2, and the third color field D3 are displayed is not limited to an sequential order of the first color field D1, the second color field D2, and the third color field D3 as described above. For example, a sequential order of the second color field D2, the first color field D1, and the third color field D3 may be used. Further alternatively, for example, a sequential order of the third color field D3, the second color field D2, and the first color field D1 may be used.

Referring back to FIG. 2, in this embodiment, a pixel width in a horizontal direction of each pixel is L1, and a pixel width in a vertical direction of each pixel is L2. Using the pixel A10 as an example, a rightward direction along a horizontal direction of the display 200 may be used as the first direction Y1, and a pixel width L1 may be used as the distance X1. Thus, for the pixel A10, the pixel A14 at the pixel width L1 from the pixel A10 in the rightward direction along the horizontal direction of the display device 200 is determined to be the first peripheral pixel S1 of the pixel A10, and the pixel A6 at the pixel width L1 from the pixel A10 in the leftward direction along the horizontal direction of the display device 200 is determined to be the second peripheral pixel S2 of the pixel A10. Similarly, each pixel A1 to A20 respectively has a corresponding first peripheral pixel S1 and second peripheral pixel S2. For example, for the pixel A11, the pixel A15 is the first peripheral pixel S1 of the pixel A11, and the pixel A7 is the second peripheral pixel S2 of the pixel A11. For the pixel A9, the pixel A13 is the first peripheral pixel S1 of the pixel A9, and the pixel A5 is the second peripheral pixel S2 of the pixel A9. It should be noted that the pixel width L1 and a pixel width L2 in the display 200 may be equal or unequal, and a proportion of the pixel width L1 to the pixel width L2 may be adjusted according to a design requirement.

Further, in another alternative example, an upward direction along a vertical direction of the display device 200 may be used as the first direction Y1, and the pixel width L2 may be used as the distance X1. Therefore, for the pixel A10, the pixel A9 at the pixel width L2 from the pixel A10 in the upward direction of the display device 200 is determined to be the first peripheral pixel S1 of the pixel A10, and the pixel A11 at the pixel width L2 from the pixel A10 in the downward direction of the display device 200 is determined to be the second peripheral pixel S2 of the pixel A10. It should be noted that, in an actual application, the direction Y1 is not limited to being along the horizontal or vertical direction of the display device 200, and may be any direction, and the distance X1 is not limited to the pixel width L1 or the pixel width L2, and may be any distance.

Continue referring to FIGS. 1 and 2, the controller 220 is electrically coupled to the display panel 210, and the controller 220 includes an image analysis unit 222 and a computation unit 224. In an actual application, the controller 220 may include fewer or more units. For example, the controller 220 may further include a logic unit of another function. As shown in FIG. 2, an example in which the controller 220 includes the image analysis unit 222 and the computation unit 224 is used only for ease of subsequent description; however, this embodiment is not limited thereto. In Step S120, the image analysis unit 222 is configured to determine, from the pixels A1 to A20, a plurality of color breakup pixels BU1 to BU4 according to the second color field D2 of each pixel A1 to A20, the first color field D1 of the first peripheral pixel S1 of each pixel A1 to A20, the third color field D3 of the second peripheral pixel S2 of each pixel A1 to A20, and the background color E of each pixel A1 to A20.

Figure 3B:
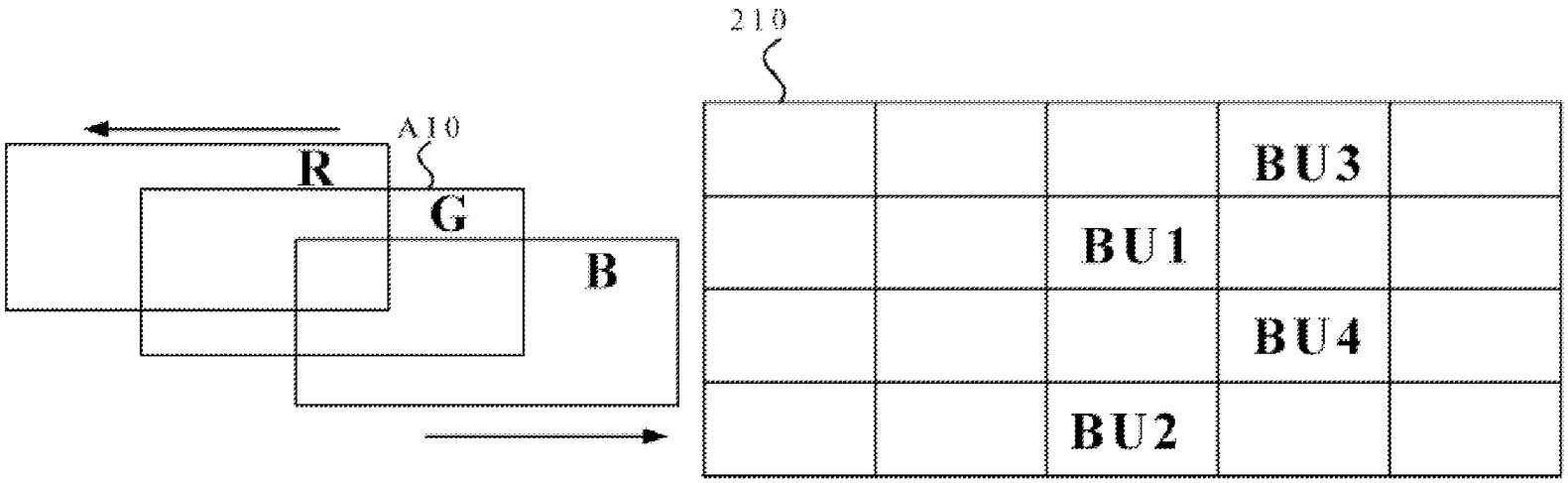
FIG. 3B is a schematic concept diagram according to steps in the display method as shown in FIG. 1.

Furthermore, FIG. 3B is a schematic concept diagram according to Step S120 in the display method 100 as shown in FIG. 1. Similarly, using the pixel A10 as an example, a rightward direction along the horizontal direction of the display device 200 is used as the first direction Y1, and the pixel width L1 is used as the distance X1. That is, the first peripheral pixel S1 of the pixel A10 is the pixel A14 and the second peripheral pixel S2 of the pixel A10 is the pixel A6. In Step S120, the image analysis unit 222 superimposes the second color field D2 of the pixel A10, the first color field D1 of the pixel A14, and the third color field D3 of the pixel A6, and compares a superimposition result with the background color E of the pixel A10. If a color difference between the superimposition result and the background color E of the pixel A10 is relatively large, it is determined that the pixel A10 is a color breakup pixel BU1 in which a color breakup phenomenon may occur. Therefore, all color breakup pixels BU1 to BU4 in which a color breakup phenomenon may occur and may be found from the pixels A1 to A20 in this manner. In practice, Step S120 may be regarded that the third color field D3 of each pixel A1 to A20 is moved by the distance X1 along the first direction Y1, the first color field D1 of each pixel A1 to A20 is moved by the distance X1 along a second direction opposite the first direction Y1, and comparison with the original background color E of each pixel A1 to A20 is performed to determine, from the pixels A1 to A20, the color breakup pixels BU1 to BU4 in which a color breakup phenomenon may occur.

Next, in Step S130, the computation unit 224 is configured to calculate a color breakup color of each of the color breakup pixels BU1 to BU4 according to the second color field D2 of each color breakup pixel BU1 to BU4, the first color field D1 of the first peripheral pixel S1 of each color breakup pixel BU1 to BU4, and the third color field D3 of the second peripheral pixel S2 of each color breakup pixel BU1 to BU4. In Step S140, the computation unit 224 calculates a compensation color C of each color breakup pixel BU1 to BU4 according to the background color E and the color breakup color F of each color breakup pixel BU1 to BU4.

Figure 3C:
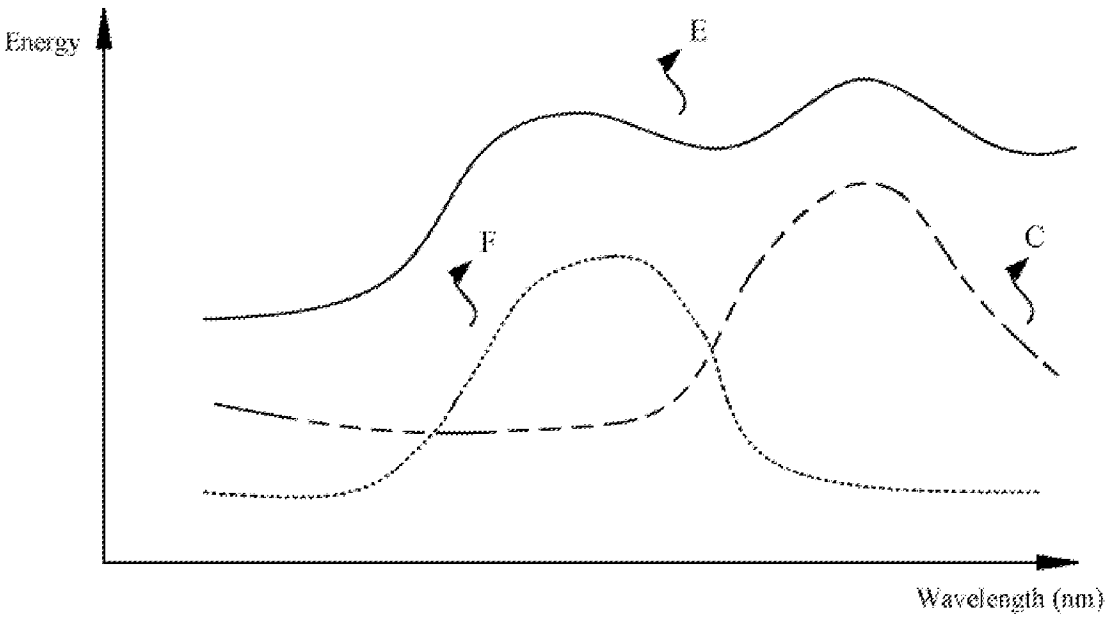
FIG. 3C is a schematic concept diagram according to steps in the display method as shown in FIG. 1.

Furthermore, FIG. 3C is a schematic concept diagram according to Steps S130 and S140 in the display method 100 as shown in FIG. 1. Specifically, in Step S120, by superimposing the second color field D2 of the pixel A10, the first color field D1 of the pixel A14, and the third color field D3 of the pixel A6, it determined that the pixel A10 is a color breakup pixel BU1 in which a color breakup phenomenon may occur. Thus, in Step S130, this superimposition result is further calculated precisely to obtain the color breakup color F of the pixel A10. As shown by a spectral curve in FIG. 3C, the color breakup color F of the pixel A10 and the background color E of the pixel A10 are not the same and have a relatively large difference when a wavelength is relatively long. Therefore, the compensation color C calculated by the computation unit 224 in Step S140 may compensate for the difference between the color breakup color F of the pixel A10 and the background color E of the pixel A10 when the wavelength is relatively long, so that after the color breakup color F of the pixel A10 and the compensation color C of the pixel A10 are superimposed, a result of superimposition may be relatively approximate to the background color E of the pixel A10. That is, curves F and C as shown in FIG. 3C are superimposed, and a result of superimposition may be relatively approximate to a curve E.

More specifically, Step S140 may further include Steps S141 to S143 (not shown in the drawings). In Step S141, the computation unit 224 converts the background color E and the color breakup color F of each color breakup pixel BU1 to BU4 to numerical values in a chromaticity coordinate XYZ by using a conversion matrix M1. In Step S142, the computation unit 224 computes a difference between the numerical values of the background color E and the numerical values of the color breakup color F of each color breakup pixel BU1 to BU4 in the chromaticity coordinate XYZ. In Step S143, the computation unit 224 converts the difference between the numerical values of the background color E and the numerical values of the color breakup color F of each color breakup pixel BU1 to BU4 to the compensation color C by using an inverse matrix M1' of the conversion matrix M1, to obtain the compensation color C of each color breakup pixel BU1 to BU4. Generally, when the numerical values of the background color E and the color breakup color F are analyzed using three primary colors, grayscale values corresponding to different colors may be represented in a grayscale coordinate RGB. However, if further computation needs to be performed, the numerical values of the background color E and the color breakup color F need to be converted from the grayscale coordinate RGB into the chromaticity coordinate XYZ by using the conversion matrix M1. The conversion matrix M1 may be represented by Formula (1) as follows:

$$\begin{bmatrix} X \\ Y \\ Z \end{bmatrix} = M1 \begin{bmatrix} R \\ G \\ B \end{bmatrix} = \begin{bmatrix} 0.5141 & 0.3239 & 0.1604 \\ 0.2651 & 0.6702 & 0.0641 \\ 0.0241 & 0.1228 & 0.8444 \end{bmatrix} \begin{bmatrix} R \\ G \\ B \end{bmatrix} \quad \text{Formula (1)}$$

Therefore, in Step S142, the difference between the numerical values of the background color E and the numerical values of the color breakup color F of each color breakup pixel BU1 to BU4 may be computed in the chromaticity coordinate XYZ. The computation of the color breakup pixel BU1 may be represented by Formula (2) as follows:

$$X_E - X_{BU1} = X_C$$

$$Y_E - Y_{BU1} = Y_C$$

$$Z_E - Z_{BU1} = Z_C \quad \text{Formula (2)}$$

where, $X_E$, $Y_E$, and $Z_E$ are the numerical values of the background color E of the color breakup pixel BU1 in the chromaticity coordinate XYZ, $X_{BU1}$, $Y_{BU1}$, and $Z_{BU1}$ are the numerical values of the color breakup color F of the color breakup pixel BU1 in the chromaticity coordinate XYZ, and $X_C$, $Y_C$, and $Z_C$ are the difference between the numerical values of the background color E and the numerical values of the color breakup color F in the chromaticity coordinate XYZ. Similarly, for each color breakup pixel BU2 to BU4, the difference between the numerical values of the background color E and the numerical values of the color breakup color F in the chromaticity XYZ coordinate $X_C$, $Y_C$, and $Z_C$ may be respectively obtained through computation according to the color breakup formula. Next, in Step S143, for each color breakup pixel BU1 to BU4, the difference $X_C$, $Y_C$, and $Z_C$ between the numerical values of the background color E and the numerical values of the color breakup color F of each color breakup pixel BU1 to BU4 is then converted to the compensation color C by using the inverse matrix M1' of the conversion matrix M1, to obtain the compensation color C of each color breakup pixel BU1 to BU4. That is, the difference $X_C$, $Y_C$, and $Z_C$ is converted from the XYZ coordinate back into the RGB coordinate by using the inverse matrix M1', to obtain the compensation color C of each color breakup pixel BU1 to BU4.

Figure 3D:
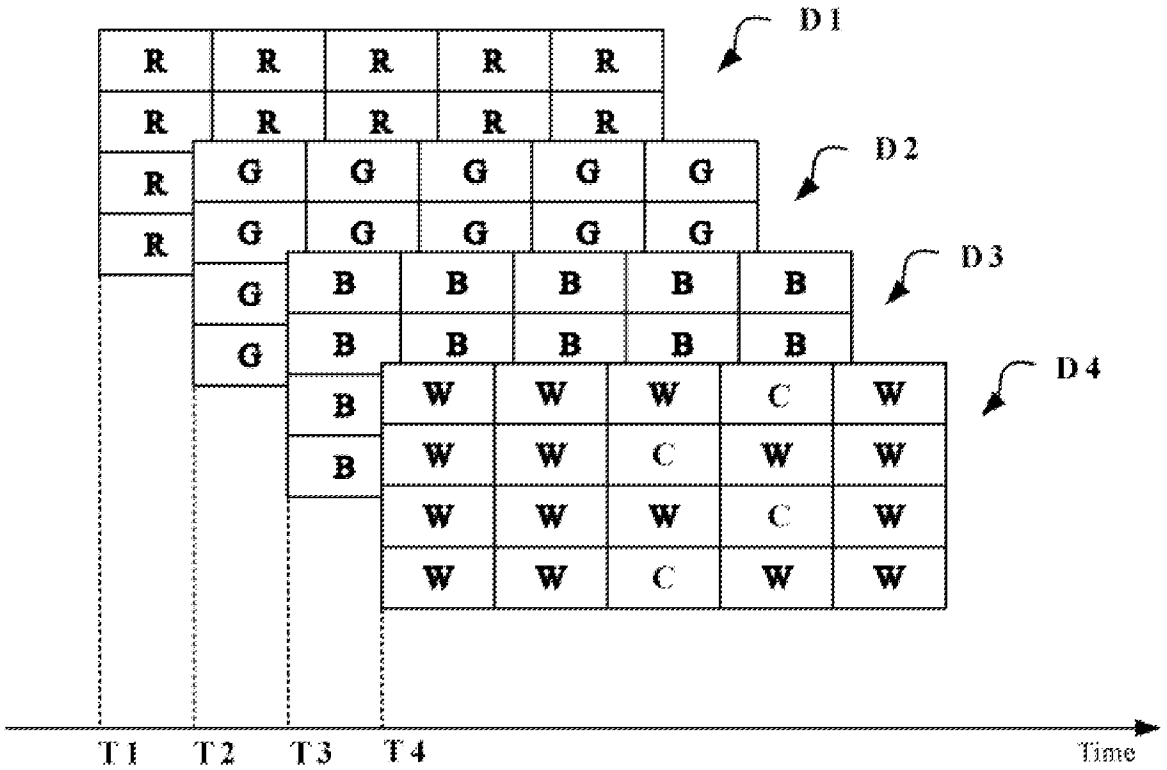
FIG. 3D is a schematic concept diagram according to steps in the display method as shown in FIG. 1.

Finally, in Step S150, the display panel 210 displays a fourth color field D4 in a fourth time period T4, where the fourth color field D4 is configured to display the compensation color C of each color breakup pixel BU1 to BU4. Referring to FIG. 3D in combination, FIG. 3D is a schematic concept diagram according to Step S150 in the display method 100 as shown in FIG. 1. It can be seen that, for each color breakup pixel BU1 to BU4, in which a color breakup phenomenon may occur, as previously determined from the pixels A1 to A20 in Step S120, the compensation color C of each color breakup pixel BU1 to BU4 is displayed in the fourth time period T4 by using the fourth color field D4. Therefore, a color breakup phenomenon is effectively reduced by displaying a compensation color of each color breakup pixel.

It needs to be noted that, in this embodiment, pixels other than the color breakup pixels BU1 to BU4 may display white light in the fourth color field D4, as shown in FIG. 3D. Because the fourth color field D4 is mainly configured to display the compensation color C of each color breakup pixel BU1 to BU4, the other pixels without the color breakup phenomenon may purely display white light without affecting the background color E of the other pixels. However, in some embodiments, for example, in consideration of use in a different scenario, the other pixels may display green light, red light, blue light, any single color light or mixed light, and the present disclosure is not limited to the foregoing examples.

The example as described above includes sequential exemplary steps, but the steps are not necessarily executed in an order that the steps are displayed. Execution of the steps in a different order falls within a consideration scope of the present disclosure. In addition, within the spirit and scope of the embodiments of the present disclosure, steps may be added, replaced, changed in order and/or omitted according to circumstances.

Figure 4:
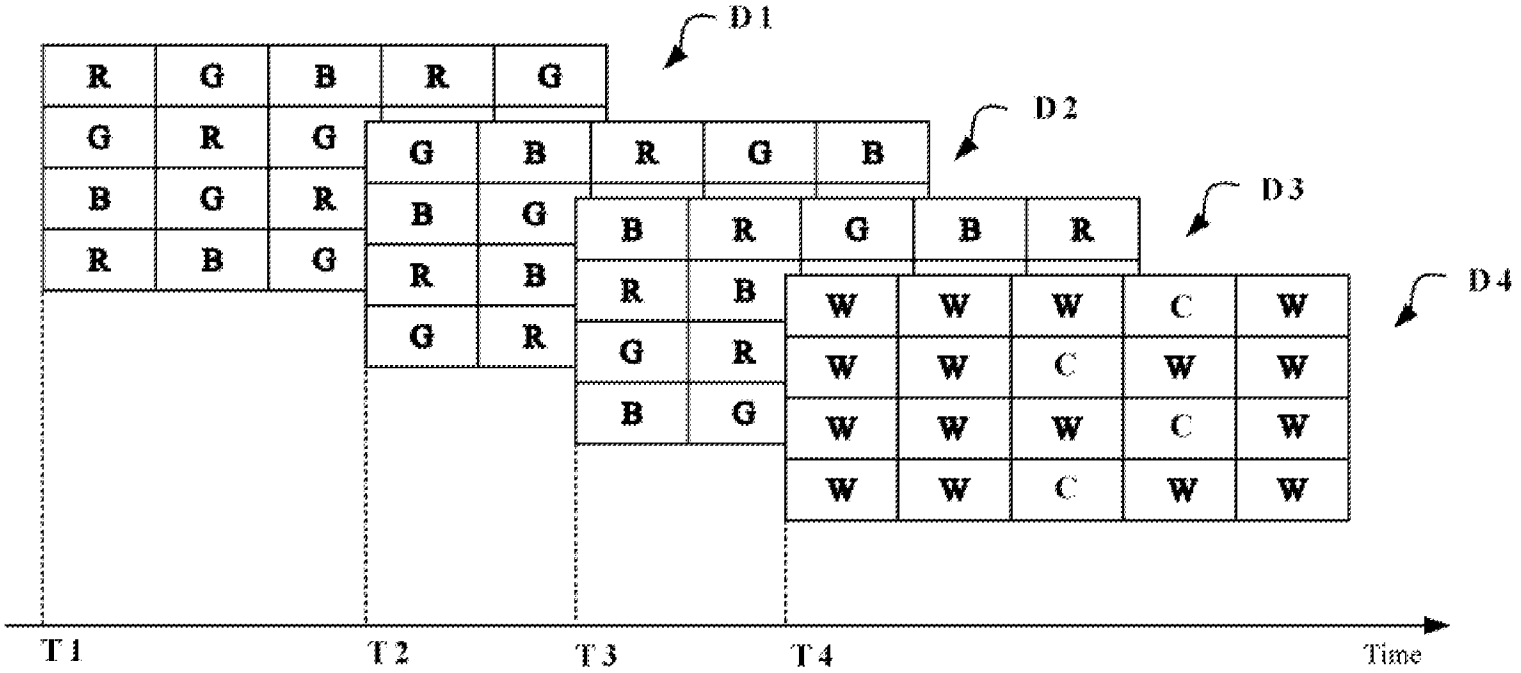
FIG. 4 is a schematic concept diagram according to the display method as shown in FIG. 1.

FIG. 4 is a schematic concept diagram according to the display method 100 as shown in FIG. 1. In some embodiments, at least one of the first color field D1, the second color field D2, and the third color field D3 in the display method 100 is a mixed color field, and the pixels A1 to A20 in the mixed color field are configured to display light of at least two single colors. As shown in FIG. 4, the first color field D1, the second color field D2, and the third color field D3 are not limited to single color fields in the previous embodiments. That is, one or more of the first color field D1, the second color field D2, and the third color field D3 may be a mixed color field, in which different pixels in each color field may display different colors of light. For example, in the first color field D1, the pixel A9 displays blue light, the pixel A5 displays green light, the pixel A13 displays red light, and the like. In the second color field D2, the pixel A9 displays red light, the pixel A5 displays blue light, the pixel A13 displays green light, and the like. In the third color field D3, the pixel A9 displays green light, the pixel A5 displays red light, the pixel A13 displays blue light, and the like. Similarly, in this embodiment, Steps S110 to S150 of the display method 100 are performed, so that not only a color breakup phenomenon is reduced, but also spatial color mixing is further achieved by using a mixed color field.

Figure 5A:
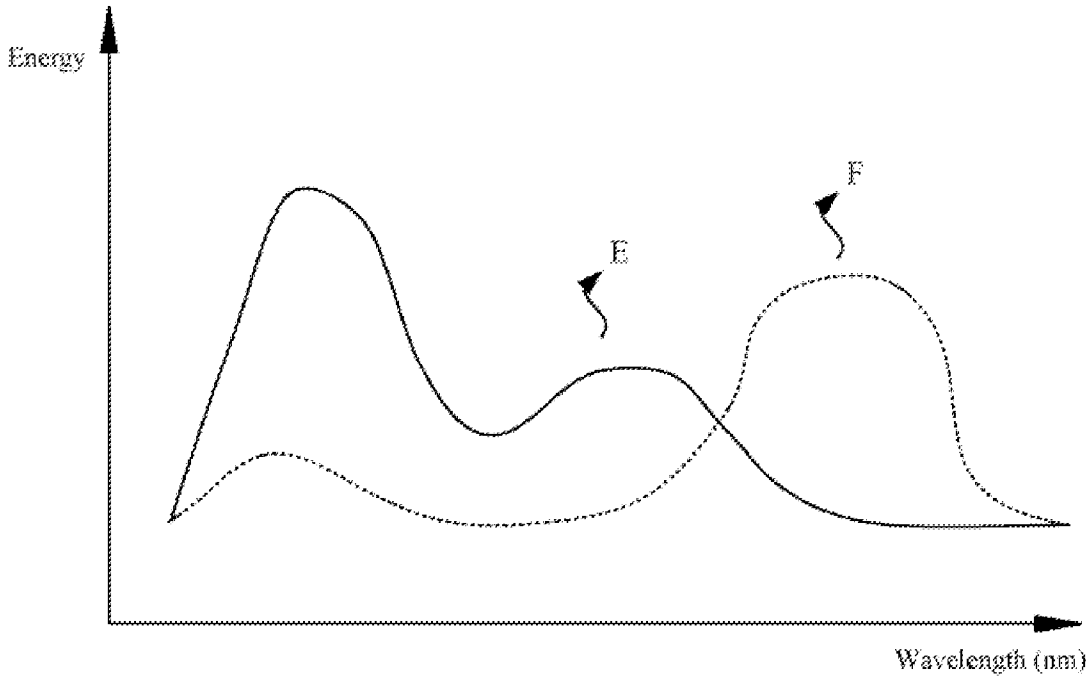
FIG. 5A is a schematic concept diagram of steps of the display method according to an embodiment of the present disclosure.
Figure 5B:
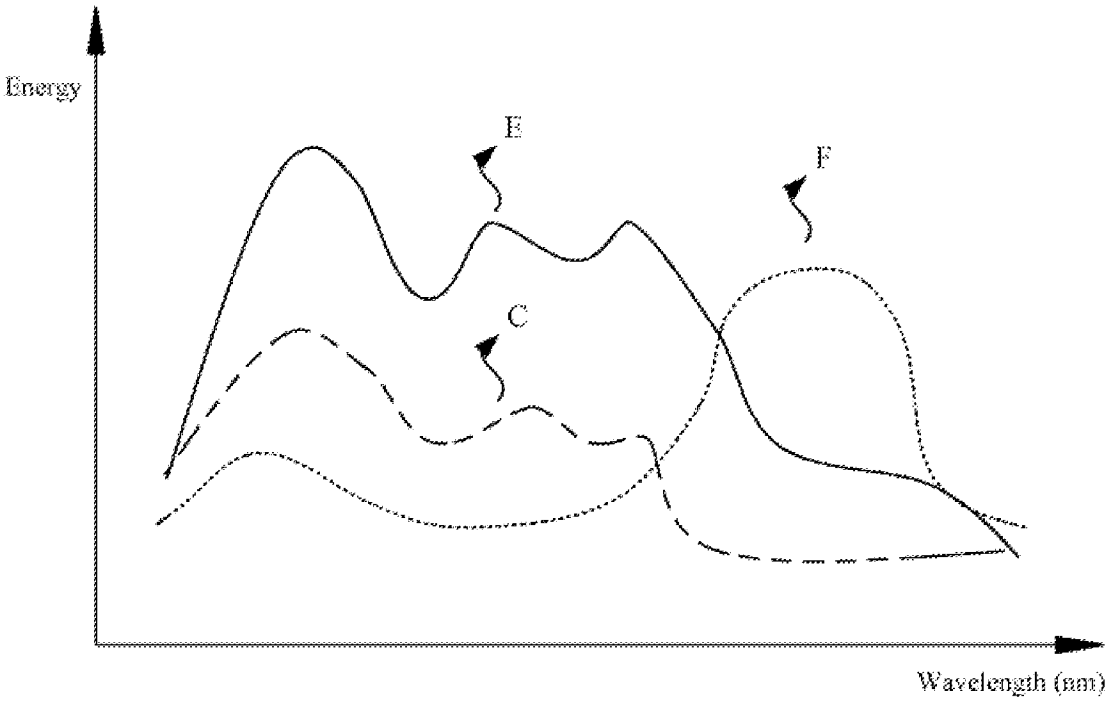
FIG. 5B is a schematic concept diagram of steps of the display method according to an embodiment of the present disclosure.

In some embodiments, the display method 100 further includes Step S170 (not shown in the drawings): calculating the compensation color C of each color breakup pixel BU1 to BU4 according to the background color E of a pixel adjacent to each color breakup pixel BU1 to BU4 and the color breakup color F of each color breakup pixel BU1 to BU4. Furthermore, FIGS. 5A and 5B are color spectrum concept diagrams of Step S170 in the display method 100 according to an embodiment of the present disclosure. In some cases, the difference between the color breakup color F and the background color E calculated for the color breakup pixel BU1 to BU4 is excessively large and is still difficult to compensate for. For example, in a case in which the background color E is single color light and the color breakup color F is multi-color light, or in a case in which the color breakup color F and the background color E are distinctly different in spectral distribution, as shown by a spectral curve in FIG. 5A, using an example in which the pixel A10 is the color breakup pixel BU1 energy of the color breakup color F is concentrated at long wavelengths, while energy of the background color E is scattered at short wavelengths and middle wavelengths. If the compensation color C of each color breakup pixel BU1 to BU4 originally calculated in Step S140 and the color breakup color F are superimposed, a result of superimposition still cannot become approximate to the background color E. Therefore, in Step S170, the background color E of a pixel adjacent to each color breakup pixel BU1 to BU4 may be used to calculate the compensation color C of each color breakup pixel BU1 to BU4. As shown in FIG. 5B, using the pixel A10 (the color breakup pixel BU1) as an example, the background color E of the pixel A6 adjacent to the pixel A10 may be used to calculate the compensation color C of the pixel A10. It may be seen that the energy of the background color E of the pixel A6 not only covers short wavelengths and middle wavelengths but also some energy covers long wavelengths. Therefore, in this example, the background color E of the pixel A6 is used to calculate the compensation color C of the pixel A10, and a color breakup phenomenon can be further reduced. In practice, in another example, for the pixel A10, any pixel of the adjacent pixels A9, A11, and A14, or even the pixel A12 adjacent by two pixel widths L2 or the pixel A18 adjacent by two pixel widths L1 may be used to calculate the compensation color C of the pixel A10, which is not limited to the foregoing example.

In some embodiments, the display method 100 further includes Step S181 (not shown in the drawings): detecting an eyeball moving speed of an observer to generate speed information; and Step S182 (not shown in the drawings): calculating, as the distance X1, a distance of translation of the first color field D1 and the third color field D3 according to the speed information. Generally, a color breakup phenomenon is related to the eyeball moving speed of the observer, that is, because each observer has a different eyeball moving speed, a position of a color breakup pixel in which a color breakup phenomenon may occur is different. Therefore, the Step S182 in this embodiment may further consider the eyeball moving speed of the observer to determine a pixel in which a color breakup phenomenon may occur. For example, when the eyeball moving speed is faster, the distance X1 of the translation of the first color field D1 and the third color field D3 is greater.

In conclusion, a color breakup phenomenon is effectively reduced by displaying a compensation color of each color breakup pixel. In addition, in some embodiments, spatial color mixing is further achieved by using a mixed color field. Alternatively, in some embodiments, when a color difference between a background color and a color breakup color is relatively large, a compensation color may be calculated by using a background color of an adjacent pixel. Further alternatively, in some embodiments, an eyeball moving speed of an observer may be further considered to determine a pixel in which a color breakup phenomenon may occur.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A display method, adapted to a display device comprising a plurality of pixels, the display method comprising:

displaying a first color field, a second color field, and a third color field respectively in a first time period, a second time period, and a third time period such that each of the pixels is configured to display a background color, wherein for each of the pixels, a first peripheral pixel is determined to be at a distance from the pixel along a first direction on the display device, and a second peripheral pixel is determined to be at the distance from the pixel along a second direction opposite the first direction;

determining, from the pixels, a plurality of color breakup pixels according to the second color field of each of the pixels, the first color field of the first peripheral pixel of each of the pixels, the third color field of the second peripheral pixel of each of the pixels, and the background color of each of the pixels;

calculating, for each of the color breakup pixels, a color breakup color of the color breakup pixel according to the second color field of the color breakup pixel, the first color field of the first peripheral pixel of the color breakup pixel, and the third color field of the second peripheral pixel of the color breakup pixel;

calculating a compensation color of each of the color breakup pixels according to the background color and the color breakup color of the color breakup pixel; and displaying, for each of the pixels, a fourth color field in a fourth time period, wherein each of the color breakup pixels is configured to display the compensation color in the fourth color field.

2. The display method according to claim 1, wherein the calculating a compensation color of each of the color breakup pixels further comprises:

converting the background color and the color breakup color of each of the color breakup pixels to numerical values in a chromaticity coordinate by using a conversion matrix;

computing a difference between the numerical values of the background color and the numerical values of the color breakup color of each of the color breakup pixels in the chromaticity coordinate; and converting the difference between the numerical values of the background color and the numerical values of the color breakup color of each of the color breakup pixels to the compensation color by using an inverse matrix of the conversion matrix, to obtain the compensation color of each of the color breakup pixels.

3. The display method according to claim 1, wherein the first direction is a horizontal direction on the display device, and the distance is at least one pixel width.

4. The display method according to claim 1, wherein at least one of the first color field, the second color field, and the third color field is a single color field.

5. The display method according to claim 1, wherein the first color field is a red color field, the second color field is green color field, and the third color field is a blue color field.

6. The display method according to claim 1, wherein at least one of the first color field, the second color field, and the third color field is a mixed color field, and the pixels in the mixed color field are configured to display light of at least two single colors.

7. The display method according to claim 1, wherein the pixels other than the color breakup pixels are configured to display white light in the fourth color field.

8. The display method according to claim 1, further comprising:

calculating the compensation color of each of the color breakup pixels according to the background colors of the pixels adjacent to the color breakup pixel and the color breakup color of the color breakup pixel.

9. The display method according to claim 1, further comprising:

detecting an eyeball moving speed of an observer to generate speed information; and calculating, as the distance, a distance of translation of the first color field and the third color field according to the speed information.

10. A display device, comprising:

a display panel comprising a plurality of pixels, the display panel being configured to display a first color field, a second color field, and a third color field respectively in a first time period, a second time period, and a third time period such that each of the pixels is configured to display a background color, wherein for each of the pixels, a first peripheral pixel is determined to be at a distance from the pixel along a first direction on the display device, and a second peripheral pixel is determined to be at the distance from the pixel along a second direction opposite the first direction; and a controller, comprising:

an image analysis unit, configured to determine, from the pixels, a plurality of color breakup pixels according to the second color field of each of the pixels, the first color field of the first peripheral pixel of each of the pixels, the third color field of the second peripheral pixel of each of the pixels, and the background color of each of the pixels; and a computation unit, configured to calculate, for each of the color breakup pixels, a color breakup color of the color breakup pixel according to the second color field of the color breakup pixel, the first color field of the first peripheral pixel of the color breakup pixel, and the third color field of the second peripheral pixel of the color breakup pixel, and calculate a compensation color of each of the color breakup pixels according to the background color and the color breakup color of the color breakup pixel, wherein the display panel is further configured to display a fourth color field in a fourth time period, and each of the color breakup pixels is configured to display the compensation color in the fourth color field.

* * * * *